US008964994B2

(12) United States Patent
Jaillet et al.

(10) Patent No.: US 8,964,994 B2
(45) **Date of Patent: *Feb. 24, 2015**

(54) ENCODING OF MULTICHANNEL DIGITAL AUDIO SIGNALS

(75) Inventors: Florent Jaillet, Chateau-Arnoux (FR); David Virette, Munich (DE)

(73) Assignee: Orange, Paris (FR)

( * ) Notice: Subject to any disclaimer, the term of this patent is extended or adjusted under 35 U.S.C. 154(b) by 377 days.

This patent is subject to a terminal disclaimer.

(21) Appl. No.: 13/139,577

(22) PCT Filed: Dec. 11, 2009

(86) PCT No.: PCT/FR2009/052491

§ 371 (c)(1),
(2), (4) Date: Jun. 14, 2011

(87) PCT Pub. No.: WO2010/070225

PCT Pub. Date: Jun. 24, 2010

(65) Prior Publication Data

US 2011/0249821 A1 Oct. 13, 2011

(30) Foreign Application Priority Data

Dec. 15, 2008 (FR) ..... 08 58560

(51) Int. Cl.
*H04R 5/00* (2006.01)
*G10L 19/008* (2013.01)

(52) U.S. Cl.
CPC ..... *G10L 19/008* (2013.01)
USPC ..... 381/22; 381/20; 381/23; 704/500; 704/501

(58) Field of Classification Search
CPC ..... H04R 5/00
USPC ..... 381/17, 22–23, 20; 704/500–501
See application file for complete search history.

(56) References Cited

U.S. PATENT DOCUMENTS

| | | | | |
|---|---|---|---|---|
| 8,379,868 | B2 * | 2/2013 | Goodwin et al. | 381/17 |
| 2007/0269063 | A1 * | 11/2007 | Goodwin et al. | 381/310 |
| 2008/0004729 | A1 * | 1/2008 | Hiipakka | 700/94 |
| 2008/0031463 | A1 * | 2/2008 | Davis | 381/17 |
| 2009/0092259 | A1 * | 4/2009 | Jot et al. | 381/17 |
| 2009/0299756 | A1 * | 12/2009 | Davis et al. | 704/500 |

FOREIGN PATENT DOCUMENTS

WO WO 2007/104882 A1 9/2007

* cited by examiner

*Primary Examiner* — Disler Paul
(74) *Attorney, Agent, or Firm* — Drinker Biddle & Reath LLP

(57) ABSTRACT

A method for coding a multi-channel audio signal representing a sound scene comprising a plurality of sound sources is provided. This method comprises decomposing the multi-channel signal into frequency bands and, per frequency band, obtaining directivity information per sound source of the sound scene, the information being representative of the spatial distribution of the sound source in the sound scene, of selecting a set of sound sources of the sound scene constituting principal sources, of matrixing the selected principal sources to obtain a sum signal with a reduced number of channels and, of coding the directivity information and of forming a binary stream comprising the coded directivity information, the binary stream being transmittable in parallel with the sum signal. A decoding method is also provided that is able to decode the sum signal and the directivity information to obtain a multi-channel signal, to an adapted coder and an adapted decoder.

20 Claims, 8 Drawing Sheets

ENCODING OF MULTICHANNEL DIGITAL AUDIO SIGNALS

CROSS-REFERENCE TO RELATED APPLICATIONS

This application is the U.S. national phase of the International Patent Application No. PCT/FR2009/052491 filed Dec. 11, 2009, which claims the benefit of French Application No. 08 58560 filed Dec. 15, 2008, the entire content of which is incorporated herein by reference.

FIELD OF THE INVENTION

The present invention pertains to the field of the coding/decoding of multi-channel digital audio signals.

More particularly, the present invention pertains to the parametric coding/decoding of multi-channel audio signals.

BACKGROUND

This type of coding/decoding is based on the extraction of spatialization parameters so that, on decoding, the listener's spatial perception can be reconstructed.

Such a coding technique is known by the name "Binaural Cue Coding" (BCC) which is on the one hand aimed at extracting and then coding the indices of auditory spatialization and on the other hand at coding a monophonic or stereophonic signal arising from a matrixing of the original multichannel signal.

This parametric approach is a low-bitrate coding. The principal benefit of this coding approach is to allow a better compression rate than the conventional procedures for compressing multi-channel digital audio signals while ensuring the backward-compatibility of the compressed format obtained with the coding formats and broadcasting systems which already exist.

The MPEG Surround standard described in the document of the MPEG ISO/IEC standard 23003-1:2007 and in the document by "Breebaart, J. and Hotho, G. and Koppens, J. and Schuijers, E. and Oomen, W. and van de Par, S.," entitled "Background, concept, and architecture for the recent MPEG surround standard on multichannel audio compression" in Journal of the Audio Engineering Society 55-5 (2007) 331-351, describes a parametric coding structure such as represented in FIG. 1.

Thus, FIG. 1 describes such a coding/decoding system in which the coder 100 constructs a sum signal ("downmix") $S_s$ by matrixing at 110 the channels of the original multi-channel signal S and provides, via a parameters extraction module 120, a reduced set of parameters P which characterize the spatial content of the original multi-channel signal.

At the decoder 150, the multi-channel signal is reconstructed (S') by a synthesis module 160 which takes into account at one and the same time the sum signal and the parameters P transmitted.

The sum signal comprises a reduced number of channels. These channels may be coded by a conventional audio coder before transmission or storage. Typically, the sum signal comprises two channels and is compatible with conventional stereo broadcasting. Before transmission or storage, this sum signal can thus be coded by any conventional stereo coder. The signal thus coded is then compatible with the devices comprising the corresponding decoder which reconstruct the sum signal while ignoring the spatial data.

This coding scheme relies on a tree structure which allows the processing of only a limited number of channels simultaneously. Thus, this technique is satisfactory for the coding and the decoding of signals of reduced complexity used in the audiovisual sector such as for example for 5.1 signals. However, it does not make it possible to obtain satisfactory quality for more complex multi-channel signals such as for example for the signals arising from direct multi-channel sound pickups or else ambiophonic signals.

Indeed, such a structure limits the exploitation of the inter-channel redundancy which may exist for complex signals. Moreover, multi-channel signals exhibiting phase oppositions, such as for example ambiophonic signals, are not well reconstructed by these techniques of the prior art.

There therefore exists a requirement for a parametric coding/decoding technique for multi-channel audio signals of high complexity which makes it possible to manage at one and the same time the signals exhibiting phase oppositions and to take into account inter-channel redundancies between the signals while being compatible with a low bitrate coding.

SUMMARY

The present invention improves the situation.

For this purpose, it proposes a method for coding a multi-channel audio signal representing a sound scene comprising a plurality of sound sources. The method is such that it comprises a step of decomposing the multi-channel signal into frequency bands and the following steps per frequency band:

- obtaining of directivity information per sound source of the sound scene, the information being representative of the spatial distribution of the sound source in the sound scene;
- selection of a set of sound sources of the sound scene constituting principal sources;
- matrixing of the selected principal sources so as to obtain a sum signal with a reduced number of channels;
- coding of the directivity information and formation of a binary stream comprising the coded directivity information, the binary stream being able to be transmitted in parallel with the sum signal.

Thus, the directivity information associated with a source gives not only the direction of the source but also the form, or the spatial distribution, of the source, that is to say the interaction that this source may have with the other sources of the sound scene.

The knowledge of this directivity information, associated with the sum signal, will allow the decoder to obtain a signal of better quality which takes into account the inter-channel redundancies in a global manner and the probable phase oppositions between channels.

Separately coding the directivity information and the sound sources per frequency band exploits the fact that the number of active sources in a frequency band is generally small, thereby increasing the coding performance.

Moreover, the sum signal arising from the coding according to the invention may be decoded by a standard decoder such as known in the prior art, thus affording interoperability with existing decoders.

The various particular embodiments mentioned hereinafter may be added independently or in combination with one another, to the steps of the coding method defined hereinabove.

In a particular embodiment of the invention, the method furthermore comprises a step of coding secondary sources from among the unselected sources of the sound scene and insertion of coding information for the secondary sources into the binary stream.

The coding of the secondary sources will thus make it possible to afford additional detail about the decoded signal, especially for complex signals of for example ambiophonic type.

The coding information for the secondary sources may for example be coded spectral envelopes or coded temporal envelopes which can constitute parametric representations of the secondary sources.

In a variant embodiment, the coding of secondary sources comprises the following steps:

construction of pseudo-sources representing at least some of the secondary sources, by decorrelation with at least one principal source and/or at least one coded secondary source;

coding of the pseudo-sources constructed; and insertion into the binary stream of an index of source used and of an index of decorrelator used for the construction step.

This applies more particularly in the case where the multi-channel signal is of high complexity, some of the secondary sources or of the diffuse sources possibly then being represented by pseudo-sources. In this typical case, it is then possible to code this representation without however increasing the coding bitrate.

In one embodiment, the coding of the directivity information is performed by a parametric representation procedure.

This procedure is of low complexity and adapts particularly to the case of a synthesis sound scene representing an ideal coding situation.

These parametric representations can comprise for example information regarding direction of arrival, for the reconstruction of a directivity simulating a plane wave or indices of selection of form of directivity from a dictionary of forms of directivities.

In another embodiment, the coding of the directivity information is performed by a principal component analysis procedure delivering base directivity vectors associated with gains allowing the reconstruction of the initial directivities.

This thus makes it possible to code the directivities of complex sound scenes whose coding cannot be represented easily by a model.

In yet another embodiment the coding of the directivity information is performed by a combination of a principal component analysis procedure and of a parametric representation procedure.

Thus, it is for example possible to perform the coding by both procedures in parallel and to choose the one which complies with a coding bitrate optimization criterion for example.

It is also possible to perform these two procedures in cascade so as simply to code some of the directivities by the parametric coding procedure and for those which are not modeled, to perform a coding by the principal component analysis procedure, so as to best represent all the directivities. The distribution of the bitrate between the two models for encoding the directivities possibly being chosen according to a criterion for minimizing the error in reconstructing the directivities.

The present invention also pertains to a method for decoding a multi-channel audio signal representing a sound scene comprising a plurality of sound sources, with the help of a binary stream and of a sum signal. The method is such that it comprises the following steps:

extraction from the binary stream and decoding of directivity information representative of the spatial distribution of the sources in the sound scene;

dematrixing of the sum signal so as to obtain a set of principal sources;

reconstruction of the multi-channel audio signal by spatialization at least of the principal sources with the decoded directivity information.

The decoding procedure thus makes it possible to reconstruct the multi-channel signal of high quality for faithful restitution of the spatialized sound taking into account the inter-channel redundancies in a global manner and the probable phase oppositions between channels.

In a particular embodiment of the decoding method, the latter furthermore comprises the following steps:

extraction from the binary stream, of coding information for coded secondary sources;

decoding of the secondary sources with the help of the extracted coding information;

grouping of the secondary sources with the principal sources for the spatialization.

The decoding of secondary sources then affords more detail about the sound scene.

In a variant embodiment, the method furthermore comprises the following step:

decoding of the secondary sources by use of an actually transmitted source and of a predefined decorrelator so as to reconstruct pseudo-sources representative of at least some of the secondary sources.

In another variant embodiment, the method furthermore comprises the following steps:

extraction from the binary stream, of a principal source index and/or of at least one coded secondary source and of an index of a decorrelator to be applied to this source;

decoding of the secondary sources by use of the source and of the decorrelator index to reconstruct pseudo-sources representative of at least some of the secondary sources.

This makes it possible to retrieve pseudo-sources representing some of the original secondary sources without however degrading the sound rendition of the decoded sound scene.

The present invention also pertains to a coder of a multi-channel audio signal representing a sound scene comprising a plurality of sound sources. The coder is such that it comprises:

a module for decomposing the multi-channel signal into frequency bands;

a module for obtaining directivity information able to obtain this information per sound source of the sound scene and per frequency band, the information being representative of the spatial distribution of the sound source in the sound scene;

a module for selecting a set of sound sources of the sound scene constituting principal sources;

a module for matrixing the principal sources arising from the selection module so as to obtain a sum signal with a reduced number of channels;

a module for coding the directivity information and a module for forming a binary stream comprising the coded directivity information, the binary stream being able to be transmitted in parallel with the sum signal.

It also pertains to a decoder of a multi-channel audio signal representing a sound scene comprising a plurality of sound sources, receiving as input a binary stream and a sum signal. This decoder is such that it comprises:

a module for extracting and decoding directivity information representative of the spatial distribution of the sources in the sound scene;

a module for dematrixing the sum signal so as to obtain a set of principal sources;

a module for reconstructing the multi-channel audio signal by spatialization at least of the principal sources with the decoded directivity information.

It finally pertains to a computer program comprising code instructions for the implementation of the steps of a coding method such as described and/or of a decoding method such as described, when these instructions are executed by a processor.

In a more general manner, a storage means, readable by a computer or a processor, optionally integrated into the coder, possibly removable, stores a computer program implementing a coding method and/or a decoding method according to the invention.

BRIEF DESCRIPTION OF THE DRAWINGS

Other characteristics and advantages of the invention will be more clearly apparent on reading the following description, given solely by way of nonlimiting example and with reference to the appended drawings in which.

DETAILED DESCRIPTION

Figure 1:
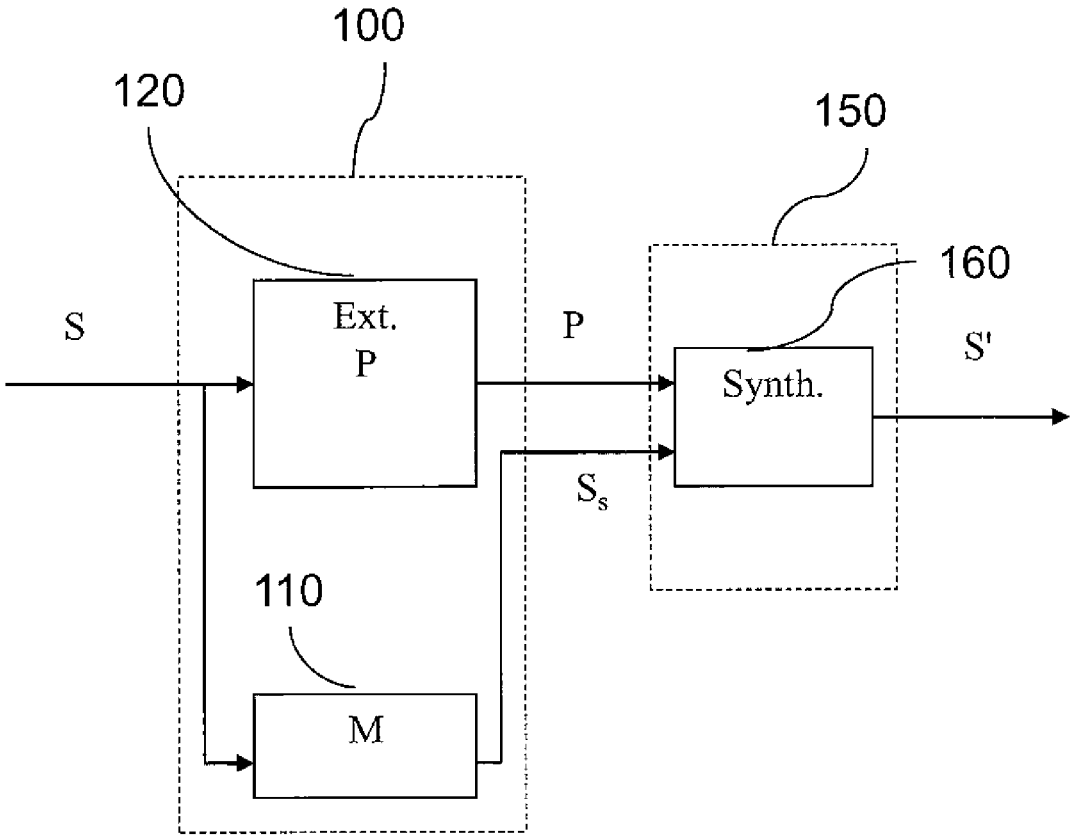
Fig. 1 (Prior art)
FIG. 1 illustrates a coding/decoding system of the state of the art of MPEG Surround standardized system type.
Figure 2:
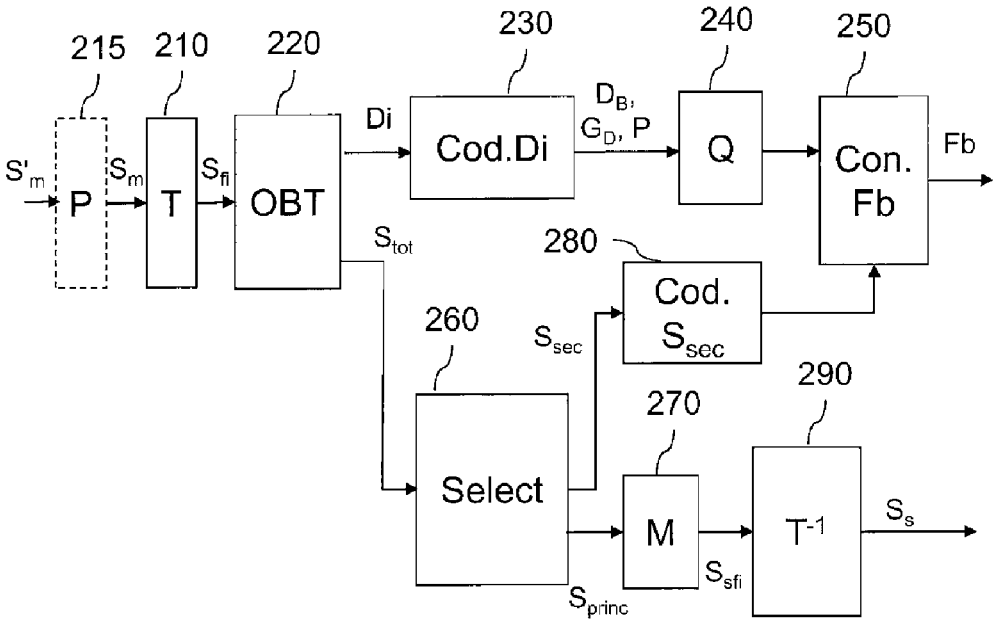
FIG. 2 illustrates a coder and a coding method according to one embodiment of the invention.

FIG. 2 illustrates in block diagram form, a coder according to one embodiment of the invention as well as the steps of a coding method according to one embodiment of the invention.

All the processing in this coder is performed per temporal frame. For the sake of simplification, the coder such as represented in FIG. 2 is represented and described by considering the processing performed on a fixed temporal frame, without showing the temporal dependence in the various notation.

One and the same processing is, however, applied successively to the set of temporal frames of the signal.

The coder thus illustrated comprises a time-frequency transform module 210 which receives as input an original multi-channel signal representing a sound scene comprising a plurality of sound sources.

This module therefore performs a step T of calculating the time-frequency transform of the original multi-channel signal. This transform is effected for example by a short-term Fourier transform.

For this purpose, each of the $n_x$ channels of the original signal is windowed over the current temporal frame, and then the Fourier transform F of the windowed signal is calculated with the aid of a fast calculation algorithm on $n_{FFT}$ points. A complex matrix X of size $n_{FFT} \times n_x$ is thus obtained, containing the coefficients of the original multi-channel signal in the frequency space.

The processing operations performed thereafter by the coder are performed per frequency band. For this purpose, the matrix of coefficients X is split up into a set of sub-matrices $X_j$ each containing the frequency coefficients in the $j^{th}$ band.

Various choices for the frequency splitting of the bands are possible. In order to ensure that the processing is applied to real signals, bands are chosen which are symmetric with respect to the zero frequency in the short-term Fourier transform. Moreover, to optimize the coding effectiveness, preference is given to the choice of frequency bands approximating perceptive frequency scales, for example by choosing constant bandwidths in the ERB (for "Equivalent Rectangular Bandwidth") or Bark scales.

For the sake of simplification, the coding steps performed by the coder will be described for a given frequency band. The steps are of course performed for each of the frequency bands to be processed.

At the output of the module 210, the signal is therefore obtained for a given frequency band $S_{fj}$.

A module for obtaining directivity information 220, makes it possible to determine by a step OBT, on the one hand, the directivities associated with each of the sources of the sound scene and on the other hand to determine the sources of the sound scene for the given frequency band.

The directivities are vectors of the same dimension as the number $n_s$ of channels of the multi-channel signal $S_m$.

Each source is associated with a directivity vector.

For a multi-channel signal, the directivity vector associated with a source corresponds to the weighting function to be applied to this source before playing it on a loudspeaker, so as to best reproduce a direction of arrival and a width of source. It is readily understood that for a very significant number of regularly spaced loudspeakers, the directivity vector will make it possible to faithfully represent the radiation of a sound source.

In the presence of an ambiophonic signal, the directivity vector will be obtained by applying an inverse spherical Fourier transform to the components of the ambiophonic orders. Indeed, the ambiophonic signals correspond to a decomposition into spherical harmonics, hence the direct correspondence with the directivity of the sources.

The set of directivity vectors therefore constitutes a significant quantity of data that it would be too expensive to transmit directly for applications with low coding bitrate. To reduce the quantity of information to be transmitted, two procedures for representing the directivities can for example be used.

The module 230 for coding Cod.Di the information regarding directivities can thus implement one of the two procedures described hereinafter or else a combination of the two procedures.

A first procedure is a parametric modeling procedure which makes it possible to utilize the a priori knowledge about the signal format used. It consists in transmitting only a much reduced number of parameters and in reconstructing the directivities as a function of known coding models.

For example, it involves utilizing the knowledge about the coding of the plane waves for signals of ambiophonic type so as to transmit only the value of the direction (azimuth and elevation) of the source. With this information, it is then possible to reconstruct the directivity corresponding to a plane wave originating from this direction.

For example, for a defined ambiophonic order, the associated directivity is known as a function of the direction of arrival of the sound source. There are several existing procedures for estimating the parameters of the model. Thus a search for spikes in the directivity diagram (by analogy with sinusoidal analysis, as explained for example in the document "*Modélisation informatique du son musical* (*analyse, transformation, synthèse*)" [*Computerized modeling of musical sound* (*analysis, transformation, synthesis*)] by Sylvain Marchand, PhD thesis, Université Bordeaux 1, allows relatively faithful detection of the direction of arrival.

Other procedures such as "matching pursuit", as presented in S. Mallat, Z. Zhang, Matching pursuit with time-frequency dictionaries, IEEE Transactions on Signal Processing 41 (1993) 3397-3415, or parametric spectral analysis, can also be used in this context.

Figure 4:
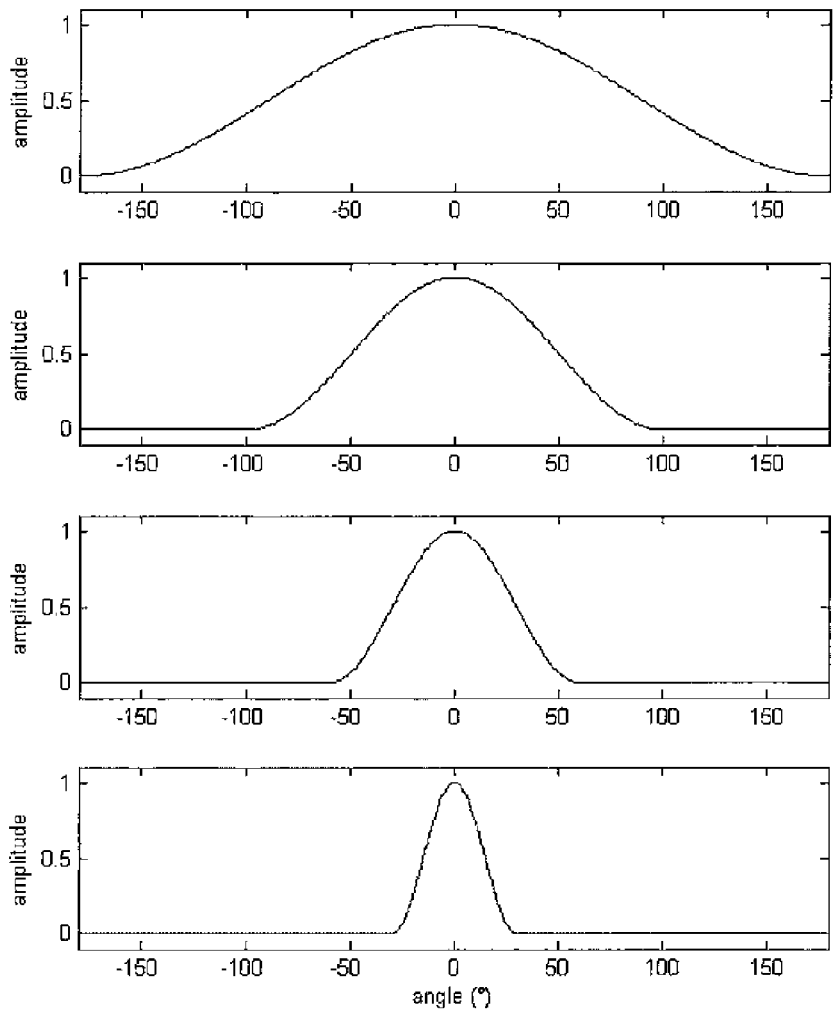
FIG. 4 represents examples of directivities used by the invention.

A parametric representation can also use a dictionary of simple form to represent the directivities. By way of example, FIG. 4 gives a few simple forms of directivities (in azimuth) that may be used. During the coding of the directivities, the corresponding azimuth and a gain making it possible to alter the amplitude of this directivity vector of the dictionary, are associated with an element of the dictionary. It is thus possible, with the help of a directivity shape dictionary, to deduce therefrom the best shape or the combination of shapes which will make it possible to best reconstruct the initial directivity.

For the implementation of this first procedure, the module 230 for coding the directivities comprises a parametric modeling module which gives as output directivity parameters P. These parameters are thereafter quantized by the quantization module 240.

This first procedure makes it possible to obtain a very good level of compression when the scene does indeed correspond to an ideal coding. This will be the case particularly in synthesis sound scenes.

However, for complex scenes or those arising from microphone sound pick-ups, it is necessary to use more generic coding models, involving the transmission of a larger quantity of information.

The second procedure described hereinbelow makes it possible to circumvent this drawback. In this second procedure, the representation of the directivity information is performed in the form of a linear combination of a limited number of base directivities. This procedure relies on the fact that the set of directivities at a given instant generally has a reduced dimension. Indeed, only a reduced number of sources is active at a given instant and the directivity for each source varies little with frequency.

It is thus possible to represent the set of directivities in a group of frequency bands with the help of a very reduced number of well chosen base directivities. The transmitted parameters are then the base directivity vectors for the group of bands considered, and for each directivity to be coded, the coefficients to be applied to the base directivities so as to reconstruct the directivity considered.

This procedure is based on a principal component analysis (PCA) procedure. This tool is amply developed by I. T. Jolliffe in "Principal Component Analysis", Springer, 2002. The application of principal component analysis to the coding of the directivities is performed in the following manner: first of all, a matrix of the initial directivities Di is formed, the number of rows of which corresponds to the total number of sources of the sound scene, and the number of columns of which corresponds to the number of channels of the original multi-channel signal. Thereafter, the principal component analysis is actually performed, which corresponds to the diagonalization of the covariance matrix, and which gives the matrix of eigenvectors. Finally, the eigenvectors which carry the most significant share of information and which correspond to the eigenvalues of largest value are selected. The number of eigenvectors to be preserved may be fixed or variable over time as a function of the available bitrate. This new base therefore gives the matrix $D_B^T$. The gain coefficients associated with this base are easily calculated with the help of $G_D = Di \cdot D_B^T$.

In this embodiment, the representation of the directivities is therefore performed with the help of a base directivity. The matrix of directivities Di may be written as the linear combination of these base directivities. Thus it is possible to write $Di = G_D D_B$, where $D_B$ is the matrix of base directivities for the set of bands and $G_B$ the matrix of associated gains. The number of rows of this matrix represents the total number of sources of the sound scene and the number of columns represents the number of base directivity vectors.

In a variant of this embodiment, base directivities are dispatched per group of bands considered, so as to more faithfully represent the directivities. It is possible for example to provide two base directivity groups: one for the low frequencies and one for the high frequencies. The limit between these two groups can for example be chosen between 5 and 7 kHz.

For each frequency band, the gain vector associated with the base directivities is thus transmitted.

For this embodiment, the coding module 230 comprises a principal component analysis module delivering base directivity vectors $D_B$ and associated coefficients or gain vectors $G_D$.

Thus, after PCA, a limited number of directivity vectors will be coded and transmitted. For this purpose, use is made of a scalar quantization performed by the quantization module 240, coefficients and base directivity vectors. The number of base vectors to be transmitted may be fixed, or else selected at the coder by using for example a threshold on the mean square error between the original directivity and the reconstructed directivity. Thus, if the error is below the threshold, the base vector or vectors so far selected are sufficient, it is not then necessary to code an additional base vector.

Figure 3A:
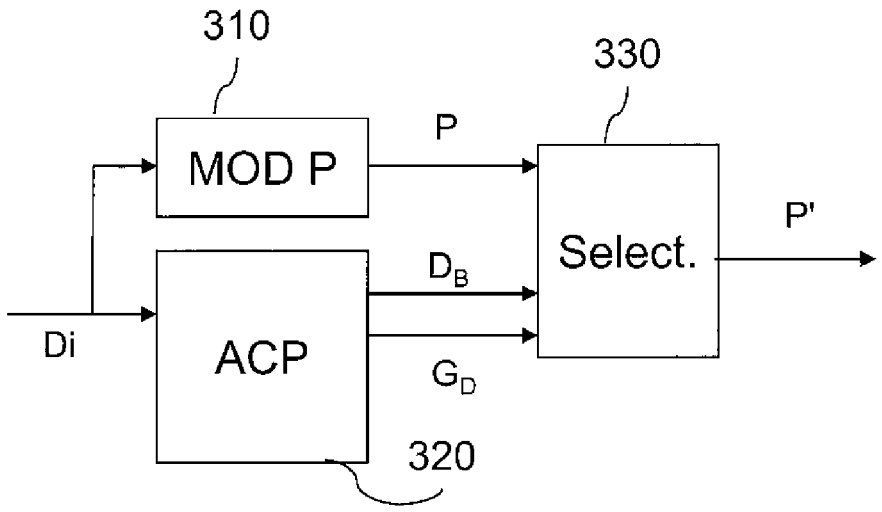
FIG. 3*a* illustrates a first embodiment of the coding of the directivities according to the invention.

In variant embodiments, the coding of the directivities is carried out by a combination of the two representations listed hereinabove. FIG. 3*a* illustrates, in a detailed manner, the directivities coding block 230 in a first variant embodiment.

This mode of coding uses the two schemes for representing the directivities. Thus, a module 310 performs a parametric modeling as explained previously so as to provide directivity parameters (P).

A module 320 performs a principal component analysis so as to provide at one and the same time base directivity vectors ($D_B$) and associated coefficients ($G_D$).

In this variant a selection module 330 chooses frequency band by frequency band, the best mode of coding for the directivity by choosing the best directivities reconstruction/bitrate compromise.

For each directivity, the choice of the representation adopted (parametric representation or linear combination of base directivities) is made so as to optimize the effectiveness of the compression.

A selection criterion is for example the minimization of the mean square error. A perceptual weighting may optionally be used for the choice of the directivity coding mode. The aim of this weighting is for example to favor the reconstruction of the directivities in the frontal zone, for which the ear is more sensitive. In this case, the error function to be minimized in the case of the PCA-based coding model can take the following form:

$$E = (W(Di - G_D D_B))^2$$

With Di, the original directivities and W, the perceptual weighting function.

The directivity parameters arising from the selection module are thereafter quantized by a step Q by the quantization module 240 of FIG. 2.

Figure 3B:
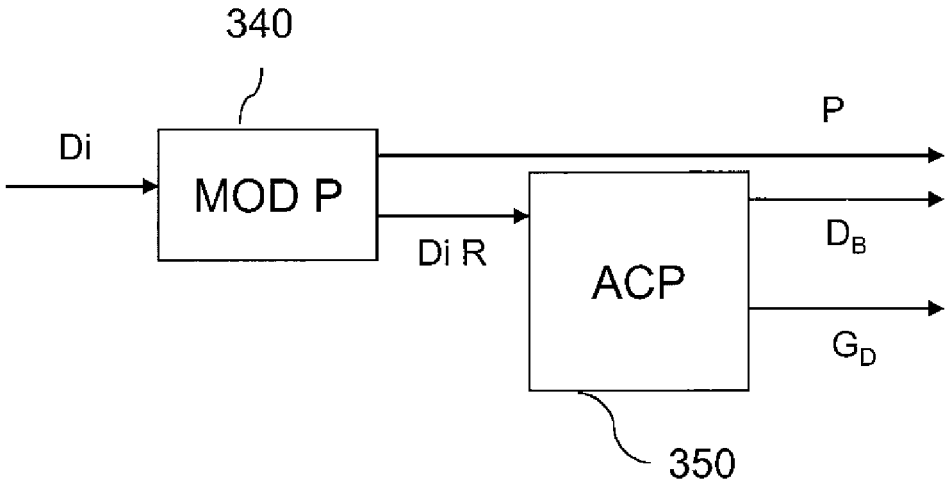
FIG. 3*b* illustrates a second embodiment of the coding of the directivities according to the invention.

In a second variant of the coding block 230, the two modes of coding are cascaded. FIG. 3*b* illustrates this coding block in detail. Thus, in this variant embodiment, a parametric modeling module 340 performs a modeling for a certain number of directivities and provides as output at one and the same time directivity parameters (P) for the modeled directivities and unmodeled directivities or residual directivities DiR.

These residual directivities (DiR) are coded by a principal component analysis module 350 which provides as output base directivity vectors ($D_B$) and associated coefficients ($G_D$).

The directivity parameters, the base directivity vectors as well as the coefficients are provided as input for the quantization module 240 of FIG. 2.

The quantization Q is performed by reducing the accuracy as a function of data about perception, and then by applying an entropy coding. Hence, possibilities for utilizing the redundancy between frequency bands or between successive frames may make it possible to reduce the bitrate. Intra-frame or inter-frame predictions about the parameters can therefore be used. Generally, conventional quantization procedures will be able to be used. Moreover, the vectors to be quantized being orthonormal, this property may be utilized during the scalar quantization of the components of the vector. Indeed, for a vector of dimension N, only N−1 components will have to be quantized, the last component being able to be recalculated.

Returning to the description of FIG. 2, at the output of the quantizer 240, a module for constructing a binary stream 250 inserts this coded directivity information into a binary stream Fb according to the step Con.Fb.

The coder such as described here furthermore comprises a selection module 260 able to select in the Select step principal sources ($S_{princ}$) from among the sources of the sound scene to be coded ($S_{tot}$).

For this purpose, a particular embodiment uses a procedure of principal component analysis (PCA) in each frequency band in the block 220 so as to extract all the sources from the sound scene ($S_{tot}$). This analysis makes it possible to rank the sources in sub-bands by order of importance according to the energy level for example.

The sources of greater importance (therefore of greater energy) are then selected by the module 260 so as to constitute the principal sources ($S_{princ}$), which are thereafter matrixed in step M by the module 270 so as to construct a sum signal ($S_{sfi}$) (or "downmix").

The number of principal sources ($S_{princ}$) is chosen as a function of the number of channels of the sum signal. This number is chosen less than or equal to the number of channels. Preferably, a number of principal sources equal to the number of channels of the sum signal is chosen. The matrix M is then a predefined square matrix.

This sum signal per frequency band undergoes an inverse time-frequency transform $T^{-1}$ by the inverse transform module 290 so as to provide a temporal sum signal ($S_s$). This sum signal is thereafter encoded by a speech coder or an audio coder of the state of the art (for example: G.729.1 or MPEG-4 AAC).

The secondary sources ($S_{sec}$) may be coded by a coding module 280 and added to the binary stream in the binary stream construction module 250.

For these secondary sources, that is to say the sources which are not transmitted directly in the sum signal, there exist various processing alternatives.

These sources being considered to be non-essential to the sound scene, they need not be transmitted.

It is however possible to code some or the entirety of these secondary sources by the coding module 280 which can in one embodiment be a short-term Fourier transform coding module. These sources can thereafter be coded separately by using the aforementioned audio or speech coders.

In a variant of this coding, it is possible for the coefficients of the transform of these secondary sources to be coded directly only in the bands which are reckoned to be important.

The secondary sources may be coded by parametric representations, these representations may be in the form of a spectral envelope or temporal envelope.

These representations are coded in the step Cod.$S_{sec}$ of the module 280 and inserted in the step Con.Fb into the binary stream. These parametric representations then constitute coding information for the secondary sources.

This method for coding a multi-channel signal such as described is particularly beneficial through the fact that the analysis is done on windows that may be of small length. Thus, this coding model gives rise to a small algorithmic delay allowing its use in applications where it is important to contain the delay.

In the case of certain multi-channel signals especially of ambiophonic type, the coder such as described implements an additional step of pre-processing P by a pre-processing module 215.

This module performs a step of change of base so as to express the sound scene using the plane wave decomposition of the acoustic field.

The original ambiophonic signal is seen as the angular Fourier transform of a sound field. Thus the various components represent the values for the various angular frequencies. The first operation of decomposition into plane waves therefore corresponds to taking the omnidirectional component of the ambiophonic signal as representing the zero angular frequency (this component is indeed therefore a real component). Thereafter, the following ambiophonic components (order 1, 2, 3, etc. . . . ) are combined to obtain the complex coefficients of the angular Fourier transform.

For a more precise description of the ambiophonic format, refer to the thesis by Jérôme Daniel, entitled "Représentation de champs acoustiques, application à la transmission et à la reproduction de scènes sonores complexes dans un contexte multimédia" [Representation of acoustic fields, application to the transmission and reproduction of complex sound scenes in a multimedia context] 2001, Paris 6.

Thus, for each ambiophonic order greater than 1 (in 2-dimensions), the first component represents the real part, and the second component represents the imaginary part. For a two-dimensional representation, for an order O, we obtain O+1 complex components. A Short-Term Fourier Transform (in temporal dimension) is thereafter applied to obtain the Fourier transforms (in the frequency domain) of each angular harmonic. This step then incorporates the transformation step T of the module 210. Thereafter, the complete angular transform is constructed by recreating the harmonics of negative frequencies by Hermitian symmetry. Finally, an inverse Fourier transform in the dimension of the angular frequencies is performed so as to pass to the directivities domain.

This pre-processing step allows the coder to work in a space of signals whose physical and perceptive interpretation is simplified, thereby making it possible to more effectively utilize the knowledge about spatial auditory perception and thus improve the coding performance. However, the coding of the ambiophonic signals remains possible without this pre-processing step.

For signals not arising from ambiophonic techniques, this step is not necessary. For these signals, the knowledge of the capture or restitution system associated with the signal makes it possible to interpret the signals directly as a plane wave decomposition of the acoustic field.

Figure 5:
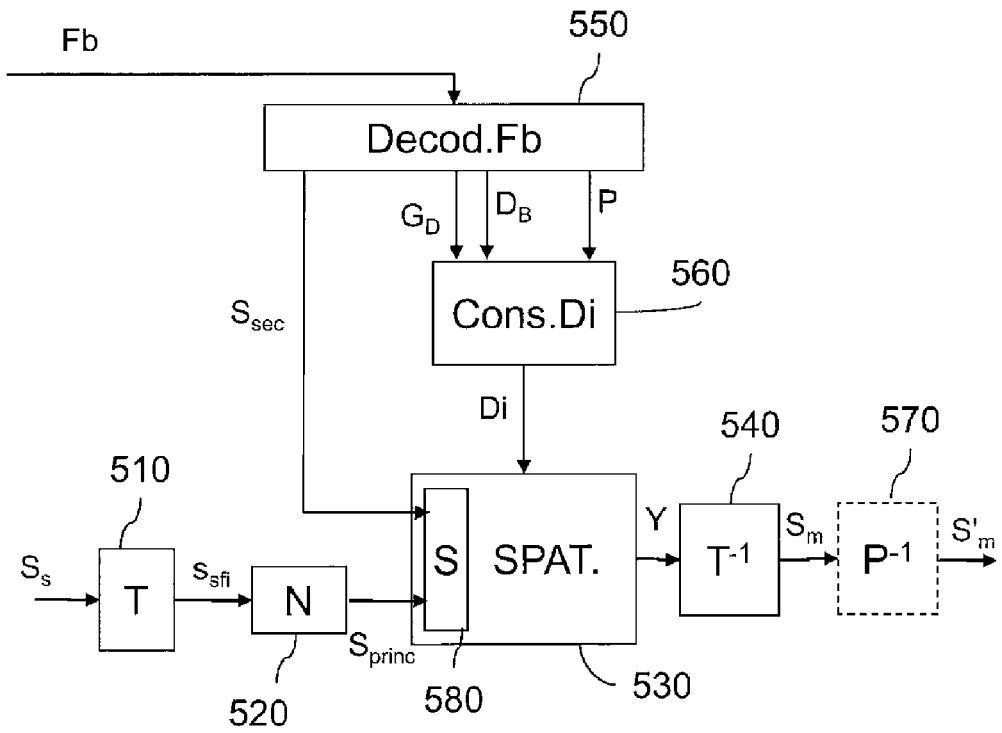
FIG. 5 illustrates a decoder and a decoding method according to one embodiment of the invention.

FIG. 5 now describes a decoder and a decoding method in one embodiment of the invention.

This decoder receives as input the binary stream $F_b$ such as constructed by the coder previously described as well as the sum signal $S_s$.

In the same manner as for the coder, all the processing operations are performed per temporal frame. To simplify the notation, the description of the decoder which follows describes only the processing performed on a fixed temporal frame and does not show the temporal dependence in the notation. In the decoder, this same processing is, however, applied successively to all the temporal frames of the signal.

To retrieve the sound sources, the first decoding step consists in carrying out the time-frequency transform T of the sum signal $S_s$ by the transform module 510 so as to obtain a sum signal per frequency band, $S_{sfi}$.

This transform is carried out using for example the short-term Fourier transform. It should be noted that other transforms or banks of filters may also be used, and especially banks of filters that are non-uniform according to a perception scale (e.g. Bark). It may be noted that in order to avoid discontinuities during the reconstruction of the signal with the help of this transform, an overlap add procedure is used.

For the temporal frame considered, the step of calculating the short-term Fourier transform consists in windowing each of the $n_f$ channels of the sum signal $S_s$ with the aid of a window w of greater length than the temporal frame, and then in calculating the Fourier transform of the windowed signal with the aid of a fast calculation algorithm on $n_{FFT}$ points. This therefore yields a complex matrix F of size $n_{FFT} \times n_f$ containing the coefficients of the sum signal in the frequency space.

Hereinafter, the whole of the processing is performed per frequency band. For this purpose, the matrix of the coefficients F is split into a set of sub-matrices $F_j$ each containing the frequency coefficients in the $j^{th}$ band. Various choices for the frequency splitting of the bands are possible. In order to ensure that the processing is applied to real signals, bands which are symmetric with respect to the zero frequency in the short-term Fourier transform are chosen. Moreover, so as to optimize the decoding effectiveness, preference is given to the choice of frequency bands approximating perceptive frequency scales, for example by choosing constant bandwidths in the ERB or Bark scales.

For the sake of simplification, the decoding steps performed by the decoder will be described for a given frequency band. The steps are of course performed for each of the frequency bands to be processed.

The module 520 performs a dematrixing N of the frequency coefficients of the transform of the sum signal of the frequency band considered so as to retrieve the principal sources of the sound scene.

More precisely, the matrix $S_{princ}$ of the frequency coefficients for the current frequency band of the $n_{princ}$ principal sources is obtained according to the relation:

$S_{princ}=BN$, where N is of dimension $n_f \times n_{princ}$ and B is a matrix of dimension $n_{bin} \times n_f$ where $n_{bin}$ is the number of frequency components (or bins) adopted in the frequency band considered.

N is calculated so as to allow the inversion of the mixing matrix M used at the coder. We therefore have the following relation: MN=I.

The number of rows of the matrix N corresponds to the number of channels of the sum signal, and the number of columns corresponds to the number of principal sources transmitted. For the matrix M, the dimensions are inverted, I being an identity matrix of dimensions $n_{princ} \times n_{princ}$.

The rows of B are the frequency components in the current frequency band, the columns correspond to the channels of the sum signal. The rows of $S_{princ}$ are the frequency components in the current frequency band, and each column corresponds to a principal source.

It should be noted that the number of principal sources $n_{princ}$ is preferably less than or equal to the number $n_f$ of channels of the sum signal so as to ensure that the operation is invertible, and can optionally be different for each frequency band.

When the scene is complex, it may happen that the number of sources to be reconstructed in the current frequency band in order to obtain a satisfactory reconstruction of the scene is greater than the number of channels of the sum signal.

In this case, additional or secondary sources are coded and then decoded with the help of the binary stream for the current band by the binary stream decoding module 550.

This decoding module then decodes the information contained in the binary stream and especially, the directivity information and if appropriate, the secondary sources.

The decoding of the secondary sources is performed by the inverse operations to those which were performed on coding.

Whatever coding procedure has been adopted for the secondary sources, if data for reconstructing or information for coding the secondary sources have been transmitted in the binary stream for the current band, the corresponding data are decoded so as to reconstruct the matrix $S_{sec}$ of the frequency coefficients in the current band of the $n_{sec}$ secondary sources. The form of the matrix $S_{sec}$ is similar to the matrix $S_{princ}$, that is to say the rows are the frequency components in the current frequency band, and each column corresponds to a secondary source.

It is thus possible to construct the complete matrix S at 680, frequency coefficients of the set of $n_{tot}=n_{princ}+n_{sec}$ sources necessary for the reconstruction of the multi-channel signal in the band considered, obtained by grouping together the two matrices $S_{princ}$ and $S_{supp}$ according to the relation $S=(S_{princ}\ S_{supp})$. S is therefore a matrix of dimension $n_{bin} \times n_{tot}$. Hence, the shape is identical to the matrices $S_{princ}$ and $S_{supp}$: the rows are the frequency components in the current frequency band, each column is a source, with $n_{tot}$ sources in total.

In parallel with the reconstruction of the sources which has just been described, the reconstruction of the directivities is carried out.

The directivity information is extracted from the binary stream in the step Decod. Fb by the module 550.

The possible outputs of this binary stream decoding module depend on the procedures for coding the directivities used on coding. They may be in the form of vectors of base directivities $D_B$ and of associated coefficients $G_D$ and/or modeling parameters P.

These data are then transmitted to a module for reconstructing the directivity information 560 which performs the decoding of the directivity information by operations inverse to those performed on coding.

The number of directivities to be reconstructed is equal to the number $n_{tot}$ of sources in the frequency band considered, each source being associated with a directivity vector.

In the case of the representation of the directivities with the help of base directivity, the matrix of directivities Di may be written as the linear combination of these base directivities. Thus, it is possible to write $Di=G_D D_B$, where $D_B$ is the matrix of the base directivities for the set of bands and $G_D$ the matrix of the associated gains. This gain matrix has a number of rows equal to the total number of sources $n_{tot}$, and a number of columns equal to the number of base directivity vectors.

In a variant of this embodiment, base directivities are decoded per group of frequency bands considered, so as to more faithfully represent the directivities. As explained in respect of the coding, it is for example possible to provide two groups of base directivities: one for the low frequencies and one for the high frequencies. A vector of gains associated with the base directivities is thereafter decoded for each band.

Ultimately, as many directivities as sources are reconstructed. These directivities are grouped together in a matrix Di where the rows correspond to the angle values (as many angle values as channels in the multi-channel signal to be reconstructed), and each column corresponds to the directivity of the corresponding source, that is to say column r of Di gives the directivity of the source which is in column r of S.

With the help of the matrix S of the coefficients of the sources and of the matrix D of the associated directivities the frequency coefficients of the multi-channel signal reconstructed in the band are calculated in the spatialization module 530 in the step SPAT., according to the relation:

$Y=SD^T$, where Y is the signal reconstructed in the band. The rows of the matrix Y are the frequency components in the current frequency band, and each column corresponds to a channel of the multi-channel signal to be reconstructed.

By reproducing the same processing in each of the frequency bands, the complete Fourier transforms of the channels of the signal to be reconstructed are reconstructed for the current temporal frame. The corresponding temporal signals are then obtained by inverse Fourier transform $T^{-1}$, with the aid of a fast algorithm implemented by the inverse transform module 540.

This therefore yields the multi-channel signal $S_m$ on the current temporal frame. The various temporal frames are thereafter combined by conventional overlap-add procedure so as to reconstruct the complete multi-channel signal.

Generally, temporal or frequency smoothings of the parameters will be able to be used equally well during analysis and during synthesis to ensure soft transitions in the sound scene. A signaling of a sharp change in the sound scene may be reserved in the binary stream so as to avoid the smoothings of the decoder in the case where a fast change in the composition of the sound scene is detected. Moreover, conventional procedures for adapting the resolution of the time-frequency analysis may be used (change of size of the analysis and synthesis windows over time).

In the same manner as at the coder, a base change module can perform a pre-processing $P^{-1}$ so as to obtain a plane wave decomposition of the signals, a base change module 570 performs the inverse operation with the help of the plane wave signals so as to retrieve the original multi-channel signal.

The coding of the embodiment described with reference to FIG. 2 makes it possible to obtain effective compression when the complexity of the scene remains limited. When the complexity of the scene is greater, that is to say when the scene contains a large number of active sources in a frequency band, or significant diffuse components, a significant number of associated sources and of directivity becomes necessary so as to obtain good restitution quality for the scene. The effectiveness of the compression is then diminished.

A variant embodiment of the coding method and of a coder implementing this method is described with reference to FIG. 6. This variant embodiment makes it possible to improve the effectiveness of coding for complex scenes.

Figure 6:
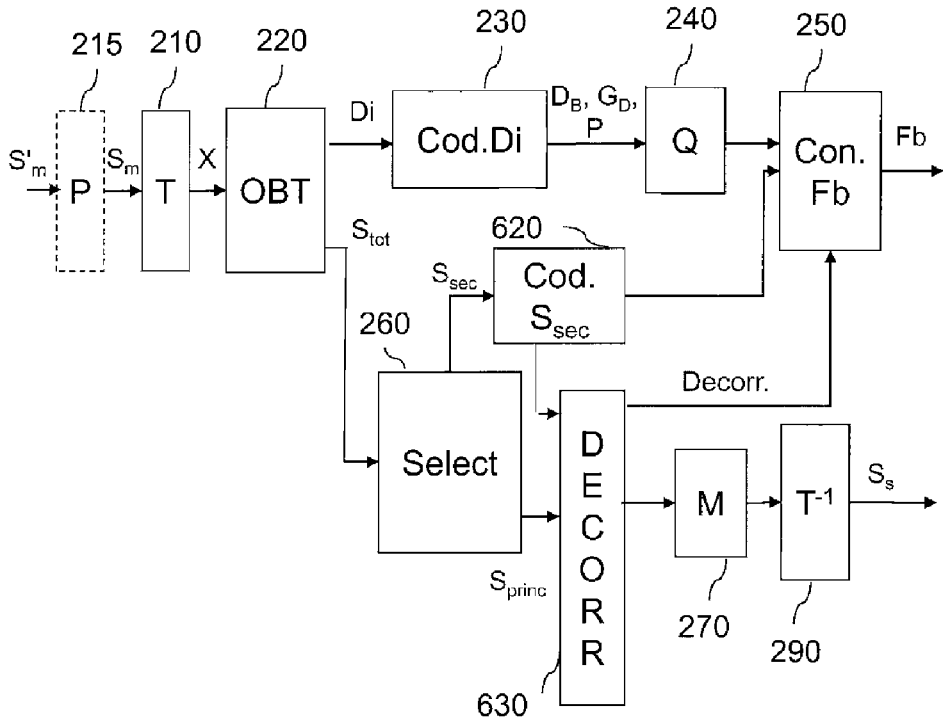
FIG. 6 represents a variant embodiment of a coder and of a coding method according to the invention.

For this purpose, the coder such as represented in FIG. 6 comprises the modules 215, 210, 220, 230, 240 such as described with reference to FIG. 2.

It also comprises the modules 260, 270 and 290 such as described with reference to FIG. 2.

This coder comprises, however, a module for coding the secondary sources 620, which differs from the module 280 of FIG. 2 in the case where the number of secondary sources is significant.

In this typical case, a procedure for parametric coding of the secondary sources is implemented by this coding module 620.

For this purpose, the limits of the spatial auditory perception are taken into account. In the frequency bands where the number of secondary sources is significant, the field can be likened perceptively to a diffuse field, and the representation of the field by one or more statistical characteristics of the field is sufficient to reconstruct a perceptively equivalent field.

This principle can be likened to the principle more conventionally used in audio coding for noisy components representation. These components are indeed commonly coded in the form of filtered white noise with filtering characteristics varying over time. To reconstruct these components in a perceptively satisfactory manner, only the knowledge of the characteristics of the filtering (the spectral envelope) is necessary, any white noise being able to be used during reconstruction.

Within the framework of the present invention, use is made of the fact that the spatially diffuse components of the sound scene may be perceptively reconstructed with the help of the simple knowledge of the corresponding directivity, and by controlling the coherence of the field created. This may be done by using pseudo-sources constructed by decorrelation, with the help of a limited number of transmitted sources and by using the directivities of the diffuse components estimated on the original multi-channel signal. The objective is then to reconstruct a sound field statistically and perceptively equivalent to the original, even if it consists of signals whose waveforms are different.

Thus, to implement this procedure, a certain number of secondary sources are not transmitted and are replaced with pseudo-sources obtained by decorrelation of the transmitted sources, or by any other artificial source decorrelated from the sources transmitted. The transmission of the data corresponding to these sources is thus avoided and the effectiveness of the coding is considerably improved.

In a first embodiment, a source to be transmitted to the decoder and a predefined decorrelator known at one and the same time to the coder and to the decoder, to be applied to the transmitted source so as to construct pseudo-sources at the decoder, are chosen.

In this embodiment, it is therefore not necessary to transmit decorrelation data but at least one source serving as the basis for this decorrelation must be transmitted (in an effective and non-parametric manner).

In a second embodiment, a parametric representation of the secondary sources is obtained by the module for coding the secondary sources 620 and is also transmitted to the module for constructing the binary stream.

This parametric representation of the secondary sources or of diffuse sources is performed for example through a spectral envelope. A temporal envelope can also be used.

In a variant of this embodiment, the pseudo-sources are calculated by a decorrelation module 630 which calculates the decorrelated sources with the help of at least one principal source or with at least one coded secondary source to be transmitted.

Several decorrelators and several initial sources may be used, and it is possible to select the initial source associated with a type of decorrelator giving the best reconstruction result. These decorrelation data such as for example the index of the correlator used and the data regarding choice of the initial source as the index of the source, are thereafter transmitted to the module for constructing the binary stream so as to be inserted thereinto.

The number of sources to be transmitted is therefore reduced while retaining good perceptive quality of the reconstructed signal.

Figure 7:
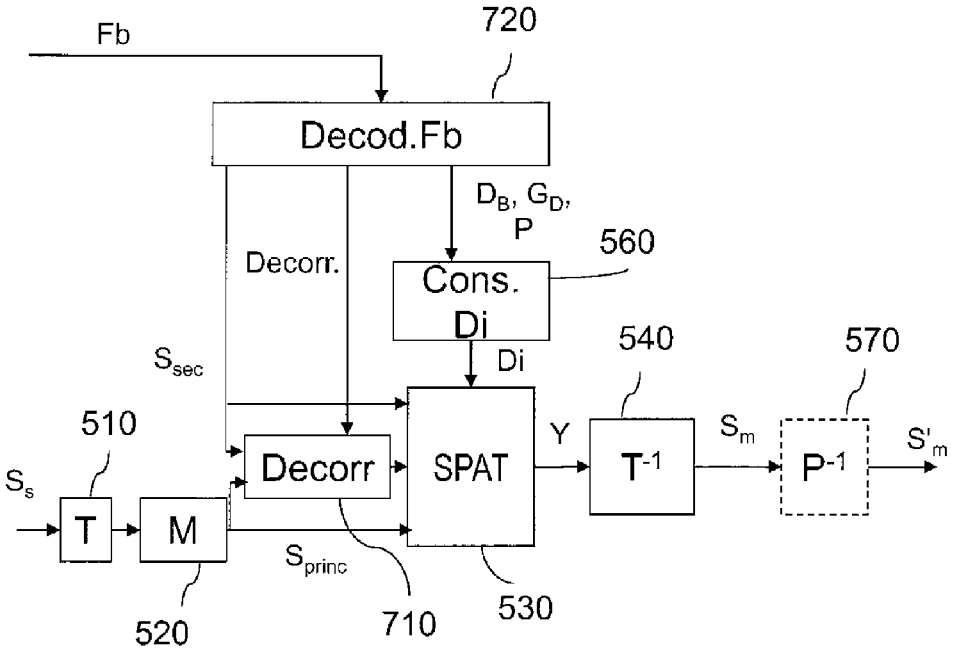
FIG. 7 represents a variant embodiment of a decoder and of a decoding method according to the invention.

FIG. 7 represents a decoder and a decoding method adapted to the coding according to the variant embodiment described in FIG. 6.

This decoder comprises the modules 510, 520, 530, 540, 570, 560 such as described with reference to FIG. 5. This decoder differs from that described in FIG. 5 by the information decoded by the module for decoding the binary stream 720 and by the decorrelation calculation block 710.

Indeed, the module 720 obtains in addition to the directivity information for the sources of the sound scene and if appropriate the decoded secondary sources, parametric data representing certain secondary sources or diffuse sources and optionally information about the decorrelator and the sources transmitted to be used in order to reconstruct the pseudo-sources.

The latter information is then used by the decorrelation module 710 which makes it possible to reconstruct the secondary pseudo-sources which will be combined with the principal sources and with the other potential secondary sources in the spatialization module as described with reference to FIG. 5.

The coders and decoders such as described with reference to FIGS. 2, 6 and 5, 7 may be integrated into a multimedia equipment of lounge-decoding type, computer or else communication equipment such as a mobile telephone or personal electronic diary.

Figure 8A:
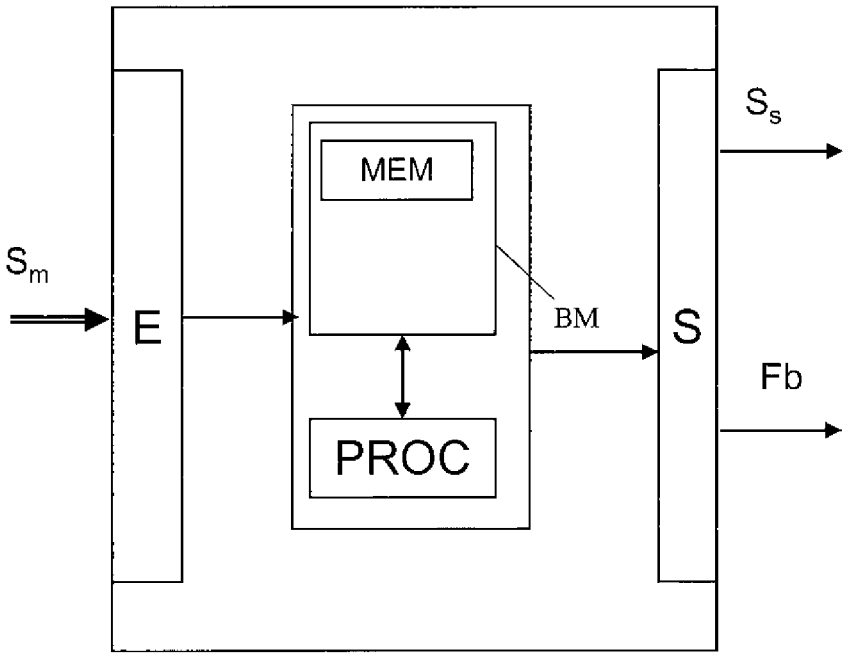
FIGS. 8*a* and 8*b* represent respectively an exemplary device comprising a coder and an exemplary device comprising a decoder according to the invention.

FIG. 8*a* represents an example of such an item of multimedia equipment or coding device comprising a coder according to the invention. This device comprises a processor PROC cooperating with a memory block BM comprising a storage and/or work memory MEM.

The memory block can advantageously comprise a computer program comprising code instructions for the implementation of the steps of the coding method within the meaning of the invention, when these instructions are executed by the processor PROC, and especially the steps of

- decomposing the multi-channel signal into frequency bands and the following steps per frequency band;
- obtaining of directivity information per sound source of the sound scene, the information being representative of the spatial distribution of the sound source in the sound scene;
- selection of a set of sound sources of the sound scene constituting principal sources;
- matrixing of the principal sources selected so as to obtain a sum signal with a reduced number of channels;
- coding of the directivity information and formation of a binary stream comprising the coded directivity information, the binary stream being able to be transmitted in parallel with the sum signal.

Typically, the description of FIG. 2 employs the steps of an algorithm of such a computer program. The computer program can also be stored on a memory medium readable by a reader of the device or downloadable to the memory space of the equipment.

The device comprises an input module able to receive a multi-channel signal representing a sound scene, either through a communication network, or by reading a content stored on a storage medium. This multimedia equipment can also comprise means for capturing such a multi-channel signal.

The device comprises an output module able to transmit a binary stream Fb and a sum signal Ss which arise from the coding of the multi-channel signal.

Figure 8B:
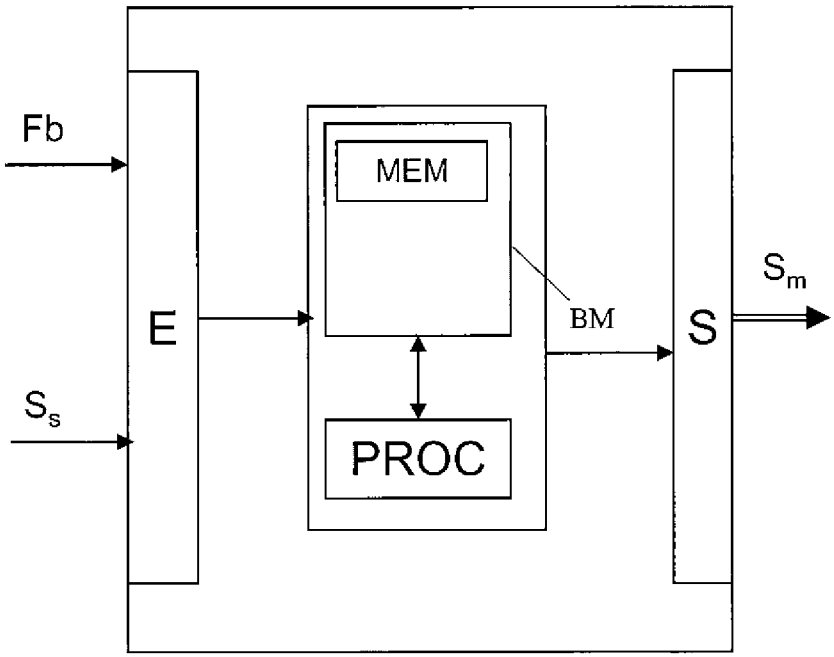

In the same manner, FIG. 8*b* illustrates an exemplary item of multimedia equipment or decoding device comprising a decoder according to the invention.

This device comprises a processor PROC cooperating with a memory block BM comprising a storage and/or work memory MEM.

The memory block can advantageously comprise a computer program comprising code instructions for the implementation of the steps of the decoding method within the meaning of the invention, when these instructions are executed by the processor PROC, and especially the steps of:

- extraction from the binary stream and decoding of directivity information representative of the spatial distribution of the sources in the sound scene;
- dematrixing of the sum signal so as to obtain a set of principal sources;
- reconstruction of the multi-channel audio signal by spatialization at least of the principal sources with the decoded directivity information.

Typically, the description of FIG. 5 employs the steps of an algorithm of such a computer program. The computer program can also be stored on a memory medium readable by a reader of the device or downloadable to the memory space of the equipment.

The device comprises an input module able to receive a binary stream Fb and a sum signal $S_s$ originating for example from a communication network. These input signals can originate from the reading of a storage medium.

The device comprises an output module able to transmit a multi-channel signal decoded by the decoding method implemented by the equipment.

This multimedia equipment can also comprise restitution means of loudspeaker type or communication means able to transmit this multi-channel signal.

Quite obviously, such multimedia equipment can comprise at one and the same time the coder and the decoder according to the invention, the input signal then being the original multi-channel signal and the output signal, the decoded multi-channel signal.

The invention claimed is:

1. A method for coding a multi-channel audio signal representing a sound scene comprising a plurality of sound sources, comprising a step of decomposing the multi-channel signal into frequency bands and the following steps per frequency band:

- obtaining directivity information for identified sound sources of the sound scene, each identified sound source having a direction and an angular width and the directivity information being representative of at least the direction and the angular width of the respective sound source in the sound scene;
- selecting from among said identified sound sources a set of sound sources of the sound scene constituting principal sources;
- matrixing only the selected principal sources to obtain a sum signal with a reduced number of channels; and coding the directivity information and forming a binary stream comprising the coded directivity information, the binary stream being transmittable in parallel with the sum signal.

2. The coding method as claimed in claim 1, further comprising a step of coding secondary sources from among unselected sources of the sound scene and inserting coding information for the secondary sources into the binary stream.

3. The method as claimed in claim 2, wherein the coding information for the secondary sources is coded spectral envelopes of the secondary sources.

4. The method as claimed in claim 2, wherein the coding of secondary sources comprises the following steps:

constructing pseudo-sources representing at least some of the secondary sources, by decorrelation with at least of: a) one principal source or b) at least one coded secondary source;

coding the pseudo-sources constructed; and inserting into the binary stream of the index of the said at least one principal source and of the index of the result of said decorrelation.

5. The method as claimed in claim 1, wherein the coding of the directivity information is performed by a parametric representation procedure.

6. The method as claimed in claim 5, wherein the parametric representation comprises information regarding direction of arrival, for the reconstruction of a directivity simulating a plane wave.

7. The method as claimed in claim 5, wherein the parametric representation comprises an element of a dictionary of forms of directivities.

8. The method as claimed in claim 1, wherein the coding of the directivity information is performed by a principal component analysis procedure delivering base directivity vectors associated with gains allowing the reconstruction of the initial directivities.

9. The method as claimed in claim 1, wherein the coding of the directivity information is performed by a combination of a principal component analysis procedure and of a parametric representation procedure.

10. The coding method as claimed in claim 1, wherein the multi-channel audio signal has more than two channels.

11. The coding method as claimed in claim 10, wherein the multi-channel audio signal is ambiophonic.

12. A method for decoding a multi-channel audio signal representing a sound scene comprising a plurality of identified principal sound sources, each identified source having a direction and an angular width, with the help of a binary stream and of a sum signal, comprising:

extracting from the binary stream and decoding directivity information representative of at least the direction and the angular width of only the identified principal sources in the sound scene;

dematrixing the sum signal to obtain a set of the principal sources; and reconstructing the multi-channel audio signal by spatialization of the principal sources with the decoded directivity information.

13. The decoding method as claimed in claim 12, further comprising:

extracting from the binary stream coding information for coded secondary sources;

decoding the secondary sources with the help of the extracted coding information; and grouping the secondary sources with the principal sources for the spatialization.

14. The decoding method as claimed in claim 13, further comprising:

decoding the secondary sources by use of an actually transmitted source and of a predefined decorrelator to reconstruct pseudo-sources representative of at least some of the secondary sources.

15. The decoding method as claimed in claim 13, further comprising:

extracting from the binary stream at least one of a principal source index or at least one coded secondary source or an index of a decorrelator to be applied to this source;

decoding the secondary sources by use of the source and the decorrelator index to reconstruct pseudo-sources representative of at least some of the secondary sources.

16. The decoding method as claimed in claim 12, wherein the multi-channel audio signal has more than two channels.

17. The decoding method as claimed in claim 16, wherein the multi-channel audio signal is ambiophonic.

18. A coder of a multi-channel audio signal representing a sound scene comprising a plurality of sound sources, the coder being configured for:

decomposing the multi-channel signal into frequency bands;

obtaining directivity information able to obtain this information for identified sound sources of the sound scene and per frequency band, each identified sound source having a direction and an angular width and the information being representative of at least the direction and the angular width of the respective sound source in the sound scene;

selecting from among said identified sound sources a set of sound sources of the sound scene constituting principal sources;

matrixing only the principal sources arising from the selection module to obtain a sum signal with a reduced number of channels; and coding the directivity information and a module for forming a binary stream comprising the coded directivity information, the binary stream being transmittable in parallel with the sum signal.

19. A decoder of a multi-channel audio signal representing a sound scene comprising a plurality of identified principal sound sources, each identified source having a direction and an angular width, that receives as input a binary stream and a sum signal, the decoder being configured for:

extracting from the binary stream and decoding directivity information representative of at least the direction and the angular width of only the identified principal sources in the sound scene;

dematrixing the sum signal to obtain a set of the principal sources; and reconstructing the multi-channel audio signal by spatialization of the principal sources with the decoded directivity information.

20. A non-transitory computer program product comprising code instructions for the implementation of the steps of at least one of the coding method as claimed in claim 1 and of the decoding method for decoding a multi-channel audio signal representing a sound scene comprising a plurality of identified principal sound sources, each identified source having a direction and an angular width, with the help of a binary stream and of a sum signal, comprising:

extracting from the binary stream and decoding directivity information representative of at least the direction and the angular width of only the identified principal sources in the sound scene;

dematrixing the sum signal to obtain a set of the principal sources; and reconstructing the multi-channel audio signal by spatialization of the principal sources with the decoded directivity information, when these instructions are executed by a processor.

* * * * *